US010263349B2

(12) United States Patent
Phillips et al.

(10) Patent No.: US 10,263,349 B2
(45) Date of Patent: Apr. 16, 2019

(54) CONNECTOR WITH COUPLING DEVICE FOR STABILIZED LATCHING

(71) Applicant: TE CONNECTIVITY CORPORATION, Berwyn, PA (US)

(72) Inventors: Michael John Phillips, Camp Hill, PA (US); Tracy Lee Smith, Harrisburg, PA (US); Steve Douglas Sattazahn, Lebanon, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 234 days.

(21) Appl. No.: 15/431,953

(22) Filed: Feb. 14, 2017

(65) Prior Publication Data

US 2018/0233855 A1 Aug. 16, 2018

(51) Int. Cl.

| | |
|---|---|
| ***H01R 13/627*** | (2006.01) |
| ***H01R 12/70*** | (2011.01) |
| ***H01R 12/79*** | (2011.01) |
| ***H01R 13/633*** | (2006.01) |

(52) U.S. Cl.
CPC ..... *H01R 12/7029* (2013.01); *H01R 12/79* (2013.01); *H01R 13/6335* (2013.01)

(58) Field of Classification Search
CPC . H01R 12/7029; H01R 12/79; H01R 13/6335
USPC ..... 439/357
See application file for complete search history.

(56) References Cited

U.S. PATENT DOCUMENTS

| | | | | |
|---|---|---|---|---|
| 5,234,357 A * | 8/1993 | Yamaguchi | H01R 13/639 | 439/354 |
| 5,613,870 A * | 3/1997 | Traver, Jr. | H01R 13/6273 | 439/352 |
| 6,257,914 B1 * | 7/2001 | Comerci | H01R 13/6273 | 439/357 |
| 6,276,958 B1 * | 8/2001 | Chih | H01R 12/7047 | 439/357 |
| 6,352,444 B1 * | 3/2002 | Yuzawa | H01R 13/514 | 385/56 |
| 6,398,577 B1 * | 6/2002 | Simmel | H01R 13/6275 | 439/341 |
| 6,454,577 B1 * | 9/2002 | Yi | H01R 13/6583 | 439/108 |
| 6,589,066 B1 * | 7/2003 | Wu | H01R 13/6275 | 439/352 |

(Continued)

*Primary Examiner* — Abdullah A Riyami
*Assistant Examiner* — Vladimir Imas

(57) ABSTRACT

An electrical connector includes a housing holding electrical conductors and a coupling device mounted to the housing for coupling the electrical connector to a mating connector. The coupling device includes an elongated stem and first and second latch arms that are located at least proximate to ends of the stem. The latch arms extend from the stem and have hook tips at distal ends thereof. The coupling device further includes a return spring beam extending from the stem and located between the latch arms. The coupling device pivots between a locking position and a depressed position. The hook tips of the latch arms protrude beyond a mating interface surface of the housing a greater extent when in the locking position than when in the depressed position to latch onto the mating connector. The return spring beam engages the housing to bias the coupling device to the locking position.

20 Claims, 6 Drawing Sheets

(56) References Cited

U.S. PATENT DOCUMENTS 6,607,397 B1 * 8/2003 Zhang ..... H01R 13/193 439/357
6,659,796 B1 * 12/2003 Waddell ..... H01R 13/745 439/352
6,702,616 B1 * 3/2004 Chang ..... H01R 13/6273 439/607.23
6,887,091 B1 * 5/2005 Wu ..... H01R 13/6335 439/352
6,902,425 B2 * 6/2005 Huang ..... H01R 13/502 439/495
6,948,973 B1 * 9/2005 Hsu ..... H01R 12/592 439/357
6,976,876 B1 * 12/2005 Su ..... H01R 13/6583 439/357
7,083,460 B2 * 8/2006 Wu ..... H01R 13/6583 439/357
7,192,297 B1 * 3/2007 Wu ..... H01R 12/592 439/358
7,413,461 B2 * 8/2008 Dawiedczyk ..... H01R 13/6275 439/357
7,540,755 B1 * 6/2009 Wu ..... H01R 13/6275 439/352
7,909,661 B2 * 3/2011 Wu ..... H01R 12/721 439/357
7,997,922 B2 * 8/2011 Dawiedczyk ..... H01R 13/6275 439/357
8,231,400 B2 * 7/2012 Phillips ..... G02B 6/4201 439/357
8,337,234 B2 * 12/2012 Sasaki ..... H01R 13/6275 439/352
8,475,054 B2 * 7/2013 Shimotsu ..... G02B 6/3817 385/75
9,397,442 B2 7/2016 Sutter et al.
2011/0294334 A1 * 12/2011 Phillips ..... G02B 6/4201 439/357

* cited by examiner

CONNECTOR WITH COUPLING DEVICE FOR STABILIZED LATCHING

BACKGROUND OF THE INVENTION

The subject matter herein relates generally to electrical connectors that releasably mate to one another via latching mechanisms.

Electrical connectors provide communicative interfaces between electrical components to transmit power and/or signals therethrough. For example, the electrical connectors may be used within telecommunication equipment, servers, and data storage or transport devices. When two electrical connectors are mated together during operation, one or both of the connectors may experience twisting forces or axial forces that pull the connectors away from each other. Typical electrical connectors include latching mechanisms configured to maintain the two connectors in the mated position to retain the communicative pathway through the connectors.

However, the latching mechanisms of some electrical connectors are inadequate to prevent the twisting and axial pull forces from interfering with the integrity of the communicative pathway defined between the connectors. For example, the latching mechanism of some known connectors is centrally located along a width of the connector, and the connector is much wider than the latching mechanism. Such a latching mechanism may provide little resistance against twisting forces that cause the mating interface of the connector to pivot relative to the mating connector. For example, one lateral edge of the mating interface may move away from the mating connector and the opposite lateral edge of the mating interface may move towards the mating connector such that electrical contacts near the lateral edges may misalign with the corresponding electrical contacts of the mating connector. The tilting movement allowed by the centrally-located latching mechanism may reduce, if not block, the signal transmission performance between the connectors. Furthermore, such tilting movement may cause damage to the electrical contacts or other components of the connectors.

Accordingly, there is a need for an electrical connector that offers more stabilized coupling to a mating connector.

BRIEF DESCRIPTION OF THE INVENTION

In one embodiment, an electrical connector is provided that includes a housing and a coupling device. The housing holds a plurality of electrical conductors that have contact portions disposed proximate to a mating end of the housing. The coupling device is mounted to the housing for selectively coupling the electrical connector to a mating connector. The coupling device includes a stem elongated a length between a first end and second end and oriented to extend across the electrical conductors. The coupling device includes first and second latch arms located at least proximate to the first and second ends of the stem. The first and second latch arms extend from the stem towards the mating end and have hook tips at distal ends thereof. The coupling device further includes a return spring beam extending from the stem and located between the first and second latch arms along the length of the stem. The coupling device is configured to pivot between a locking position and a depressed position. The hook tips of the first and second latch arms protrude beyond a mating interface surface of the housing a greater extent when in the locking position than when in the depressed position to latch onto the mating connector. The return spring beam engages the housing to bias the coupling device to the locking position.

In another embodiment, an electrical connector is provided that includes a housing and a coupling device. The housing holds a plurality of electrical conductors that have contact portions disposed proximate to a mating end of the housing. The housing has a top side and a bottom side. The housing has a base portion defining a compartment extending vertically from a platform surface to the top side. The electrical conductors are located between the platform surface and the bottom side. The coupling device is held in the compartment of the housing for selectively coupling the electrical connector to a mating connector. The coupling device includes a stem elongated a length between a first end and second end and oriented to extend across the electrical conductors. The coupling device includes first and second latch arms located at least proximate to the first and second ends of the stem. The first and second latch arms extend from the stem towards the mating end and have hook tips at distal ends thereof. The coupling device is configured to pivot between a locking position and a depressed position. The hook tips of the first and second latch arms protrude beyond a mating interface surface of the housing a greater extent when in the locking position than when in the depressed position to latch onto the mating connector.

In another embodiment, an electrical connector is provided that includes a housing and a coupling device. The housing holds a plurality of electrical conductors that have contact portions disposed proximate to a mating end of the housing. The coupling device is mounted to the housing for selectively coupling the electrical connector to a mating connector. The coupling device has a unitary, one-piece body that includes a stem, first and second latch arms, and first and second return spring beams. The stem is elongated a length between a first end and second end and oriented to extend across the electrical conductors. The first and second latch arms are located at least proximate to the first and second ends of the stem and extend from the stem towards the mating end. The first and second latch arms have hook tips at distal ends thereof. The first and second return spring beams extend from the stem and are both located between the first and second latch arms along the length of the stem. The coupling device is configured to pivot between a locking position and a depressed position. The hook tips of the first and second latch arms configured to latch onto the mating connector in the locking position and configured to release the mating connector in the depressed position. The first and second return spring beams engage the housing to bias the coupling device to the locking position.

DETAILED DESCRIPTION OF THE INVENTION

Figure 1:
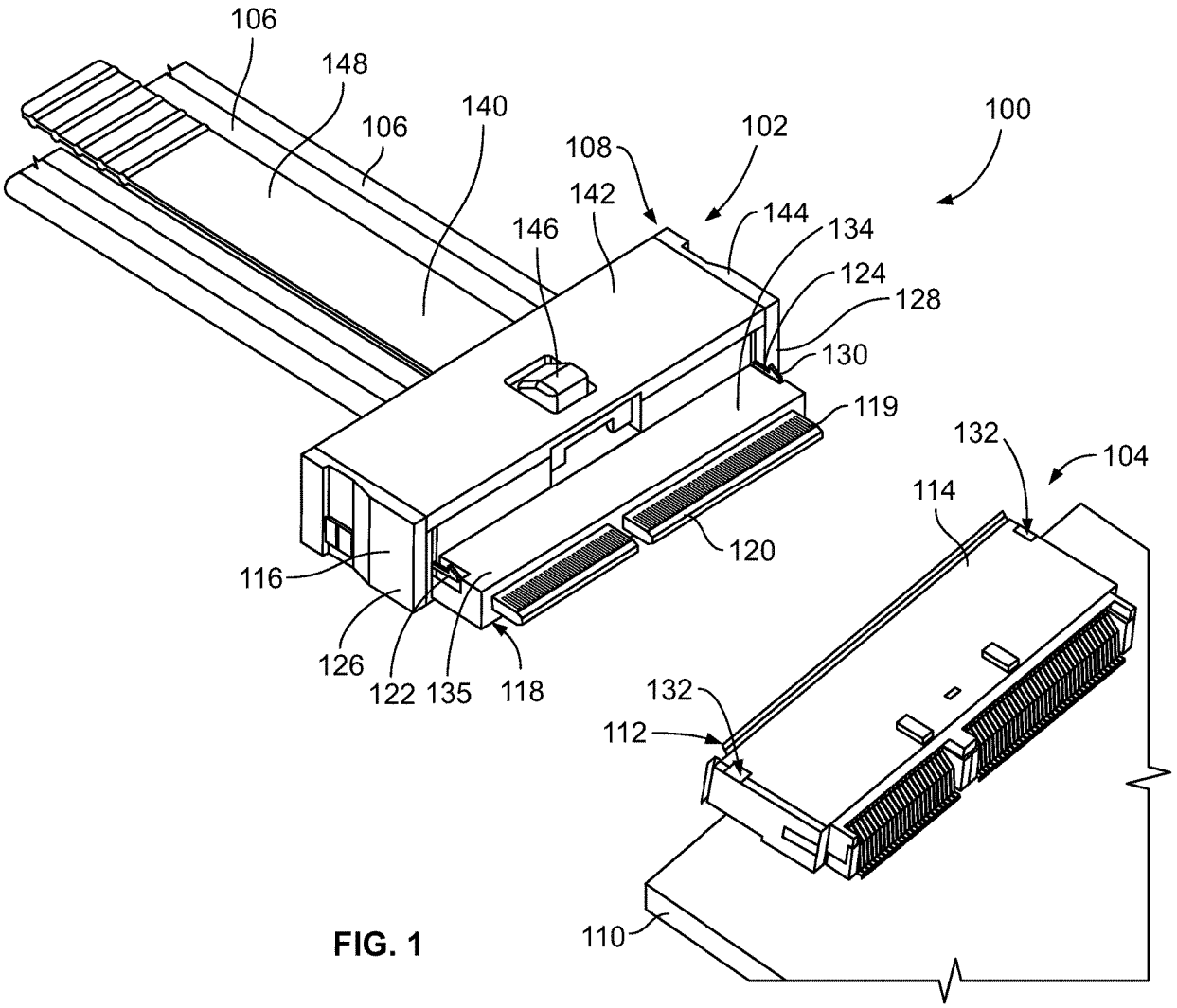
FIG. 1 is a perspective view of a connector system according to an embodiment showing a first electrical connector poised for mating to a second electrical connector.

FIG. 1 is a perspective view of a connector system 100 according to an embodiment showing a first electrical connector 102 poised for mating to a second electrical connector 104. The first electrical connector 102 is a cable-mounted connector that includes multiple electrical wires or cables 106 (e.g., a cable harness) extending from a back end 108 of the connector 102. The second electrical connector 104 is a right angle board-mounted connector that is mounted to a printed circuit board 110. In the illustrated embodiment, the second electrical connector 104 includes a shell 114 that defines a receptacle 112 configured to receive a portion of the first electrical connector 102 therein to establish a conductive connection between the connectors 102, 104 for transmitting power and/or data signals through the connectors 102, 104. The connectors 102, 104 are used to connect the electrical wires 106 (and an electrical device connected to opposite ends of the wires 106) to circuits on the printed circuit board 110. The connector system 100 may be housed within an electronic device, such as a server, a computer, or the like. The connectors 102, 104 may be high speed connectors that are configured to transmit signals at frequencies up to or exceeding 10 Gbps. Since a portion of the first electrical connector 102 plugs into the receptacle 112 of the second electrical connector 104 in the illustrated embodiment, the first electrical connector 102 is referred to herein as a plug connector 102 and the second electrical connector 104 is referred to herein as a receptacle connector 104. In an alternative embodiment, both connectors 102, 104 may be cable-mounted connectors or both connectors 102, 104 may be board-mounted connectors.

The plug connector 102 includes a housing 116 that holds and supports a plurality of electrical conductors (or conductive terminals). The housing 116 has a mating end 118 that is received in the receptacle 112. The electrical conductors have contact portions 119 disposed proximate to the mating end 118. In the illustrated embodiment, the plug connector 102 includes at least one circuit card 120. The electrical conductors include or represent electrical traces and other conductive elements on the circuit card 120. The electrical conductors and the contact portions 119 thereof are arranged side-by-side across a lateral width of the plug connector 102. The circuit card 120 protrudes from the mating end 118 of the housing 116, and the contact portions 119 of the electrical conductors are contact pads on the circuit card 120. Although not shown, the electrical conductors of the plug connector 102 held within the housing 116 may also include conductive cores of the wires 106 and conductive termination elements, such as crimp ferrules, conductive vias, solder pads, and the like, for terminating the wires 106 to the at least one circuit card 120. In an alternative embodiment, the electrical conductors of the plug connector 102 may include contact beams or other conductors instead of conductive traces and contact pads on a circuit card.

The plug connector 102 further includes first and second latch arms 122, 124 that are used to selectively couple or lock the plug connector 102 to the receptacle connector 104 in a mated configuration. In the illustrated embodiment, the latch arms 122, 124 are disposed at least proximate to corresponding first and second sides 126, 128 of the housing 116. The latch arms 122, 124 each includes a hook tip 130 configured to be received within a corresponding opening 132 of the shell 114 of the receptacle connector 104 when the connectors 102, 104 are mated to lock the connectors 102, 104 in the mated configuration. As shown in FIG. 1, the latch arms 122, 124 are spaced apart laterally from each other a distance that is approximately the entire width of a tongue portion 134 of the housing 116 that is received within the receptacle 112. In addition, the two latch-receiving openings 132 in the shell 114 are spaced apart laterally from each other a distance that is approximately the entire width of the shell 114. Therefore, when the hook tips 130 of the latch arms 122, 124 are received within the openings 132, the plug connector 102 is stably locked to the shell 114 of the receptacle connector 104. The wide latching stance increases the ability of the plug connector 102 to withstand twisting forces without pivoting or twisting within the receptacle 112 compared to known connectors that have narrow latching mechanisms. Furthermore, the wide latching stance described herein may also increase the axial pull load that can be absorbed by the plug connector 102 without uncoupling from the receptacle connector 104 relative to known connectors.

The latch arms 122, 124 represent components of a coupling device 136 (shown in FIG. 2) that is mounted to the housing 116. The latch arms 122, 124 are joined together by the coupling device 136. As described in more detail herein, the coupling device 136 is configured to selectively pivot between a locking position and a depressed position. In the locking position, the hook tips 130 of the latch arms 122, 124 are positioned to be received through the openings 132 of the receptacle connector 104 to lock the connectors 102, 104 together in the mated position. In the depressed position, the hook tips 130 do not extend through the openings 132, and therefore the latch arms 122, 124 do not lock the connectors 102, 104 together. For example, in the locking position the hook tips 130 protrude beyond a mating interface surface of the housing 116 that interfaces with the receptacle connector 104. In the depressed position, the hook tips 130 either do not protrude beyond the mating interface surface or protrude a lesser extent or distance beyond the mating interface surface than when in the locking position. In the illustrated embodiment, the mating interface surface is an outer surface 135 of the tongue portion 134 of the housing 116. In an alternative embodiment in which the coupling device 136 is held by the receptacle connector, the mating interface surface may be an interior surface within the receptacle 112.

The plug connector 102 further includes a tether 140 and a cover plate 142. The cover plate 142 is mounted to a top side 144 of the housing 116. As used herein, relative or spatial terms such as "top," "bottom," "front," "rear," "left," and "right" are only used to distinguish the referenced elements and do not necessarily require particular positions or orientations in the connector system 100 or in the surrounding environment of the connector system 100. The tether 140 and the coupling device 136 are held vertically between the cover plate 142 and the housing 116. The tether 140 includes a push button 146 and a free segment 148 that extends from the back end 108 of the connector 102. As described in more detail herein, the tether 140 is configured to be actuated by a user to selectively pivot the coupling device 136 to depress the latch arms 122, 124 in order to uncouple the plug connector 102 from the receptacle connector 104. For example, the push button 146 may be depressed (downward towards the circuit card 120) and/or the free segment 148 may be pulled rearward (in a direction away from the receptacle connector 104) in order to pivot the coupling device 136.

Figure 2:
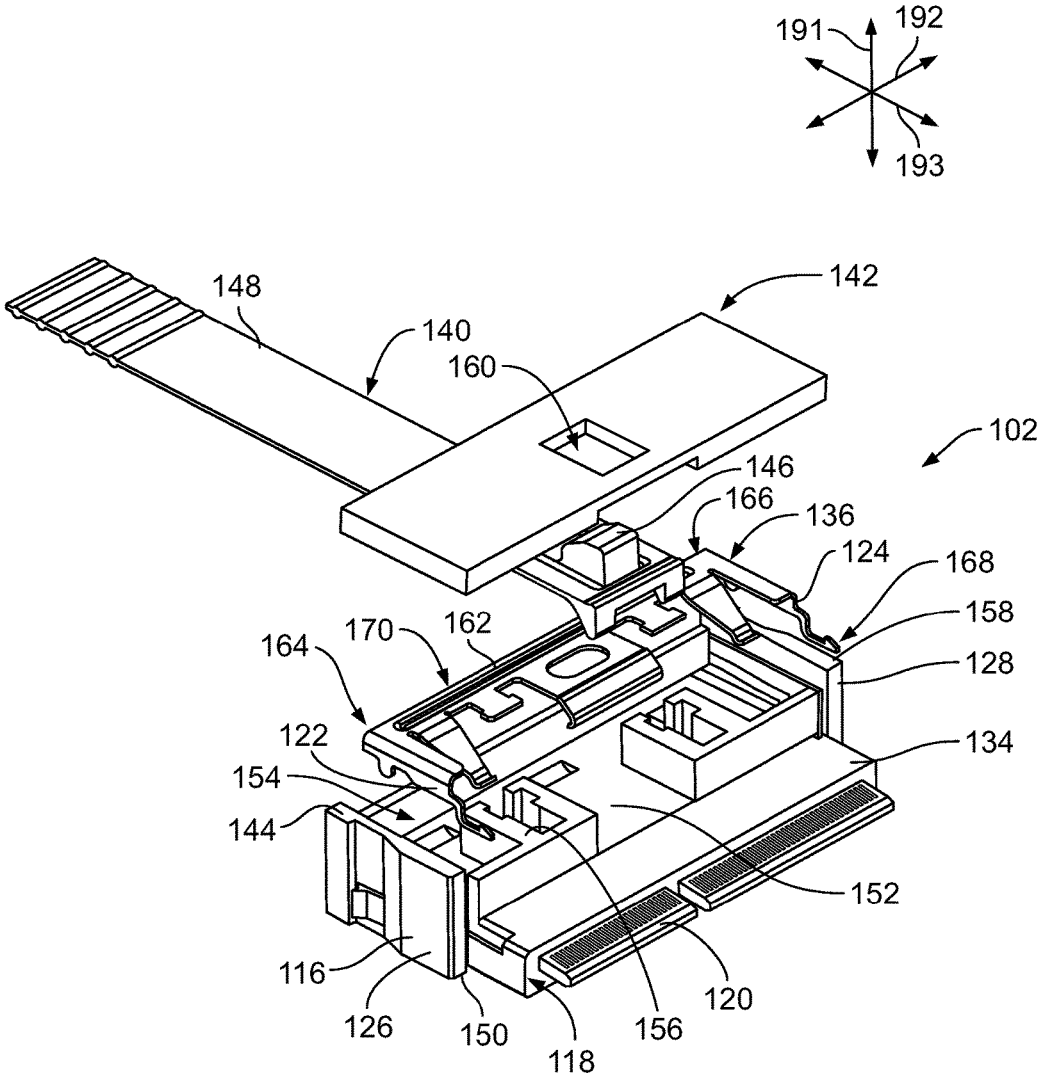
FIG. 2 is an exploded perspective view of the first electrical connector according to an embodiment.

FIG. 2 is an exploded perspective view of the plug connector 102 according to an embodiment. The electrical wires 106 are not shown in FIG. 2. The plug connector 102 is oriented with respect to a vertical or elevation axis 191, a lateral axis 192, and a longitudinal axis 193. The axes 191-193 are mutually perpendicular. Although the vertical axis 191 appears to extend generally parallel to gravity, it is understood that the axes 191-193 are not required to have any particular orientation with respect to gravity.

The housing 116 extends vertically between the top side 144 and an opposite bottom side 150. The housing 116 includes a platform surface 152 disposed between the top and bottom sides 144, 150. The at least one circuit card 120 and the electrical conductors held by the housing 116 are disposed vertically below the platform surface 152. For example, the housing 116 may define a cavity (not shown) defined vertically between the platform surface 152 and the bottom side 150. The housing 116 defines a compartment 154 between the platform surface 152 and the top side 144. The compartment 154 is sized to receive the coupling device 136. The coupling device 136 may engage the platform surface 152. In an embodiment, the housing 116 is composed of an insulative material, such as one or more plastics. The housing 116 may be formed via a molding process. The housing 116 in the illustrated embodiment includes molded walls 156 that at least partially define boundaries of the compartment 154. At least some of the walls 156 may engage the coupling device 136 to block and/or guide movement of the coupling device 136. The compartment 154 is defined along a base portion 158 of the housing 116. The base portion 158 is not received within the receptacle 112 of the connector 104 (shown in FIG. 1). The tongue portion 134 of the housing 116, which is received within the receptacle 112, extends from the base portion 158 to the mating end 118 of the housing 116.

The components of the plug connector 102 in the exploded view shown in FIG. 2 are spaced apart vertically from one another along the vertical axis 191. To assemble the plug connector 102, the coupling device 136 is received in the compartment 154, the tether 140 is placed over the coupling device 136, and the cover plate 142 is placed over the tether 140. The cover plate 142 is mounted to the top side 144 of the housing 116 to enclose the compartment 154, which encases or traps the coupling device 136 and a fixed end of the tether 140 within the compartment 154. The tether 140 and the coupling device 136 are therefore stacked vertically within the compartment 154, although the free segment 148 of the tether 140 protrudes rearward from the housing 116. The cover plate 142 includes a window 160 through which the push button 146 of the tether 140 extends when the plug connector 102 is assembled (as shown in FIG. 1). Therefore, the push button 146 and the free segment 148 of the tether 140 protrude outside of the compartment 154 and are accessible to a user. The cover plate 142 may be mounted to the housing 116 via fasteners (e.g., latches), an adhesive, or the like.

The coupling device 136 includes a stem 162 that is elongated to extend a length between a first end 164 and a second end 166. When the coupling device 136 is assembled to the housing 116, the stem 162 extends parallel to the lateral axis 192. For example, the stem 162 is oriented to extend across (e.g., transverse to) the electrical conductors that are held within the housing 116, which extend generally longitudinally through the housing 116. As shown in the illustrated embodiment, the stem 162 may extend along a majority of the width of the housing 116 between the first and second sides 126, 128. The first latch arm 122 is located at least proximate to the first end 164 of the stem 162, and the second latch arm 124 is located at least proximate to the second end 166 of the stem 162. The latch arms 122, 124 are located at the respective ends 164, 166 in the illustrated embodiment, but may be spaced slightly inboard from the ends 164, 166 in other embodiments. The latch arms 122, 124 extend from the stem 162 towards the mating end 118 of the housing 116. The coupling device 136 includes a front end 168 and an opposite rear end 170. The front end 168 faces the mating end 118 of the housing 116.

Figure 3:
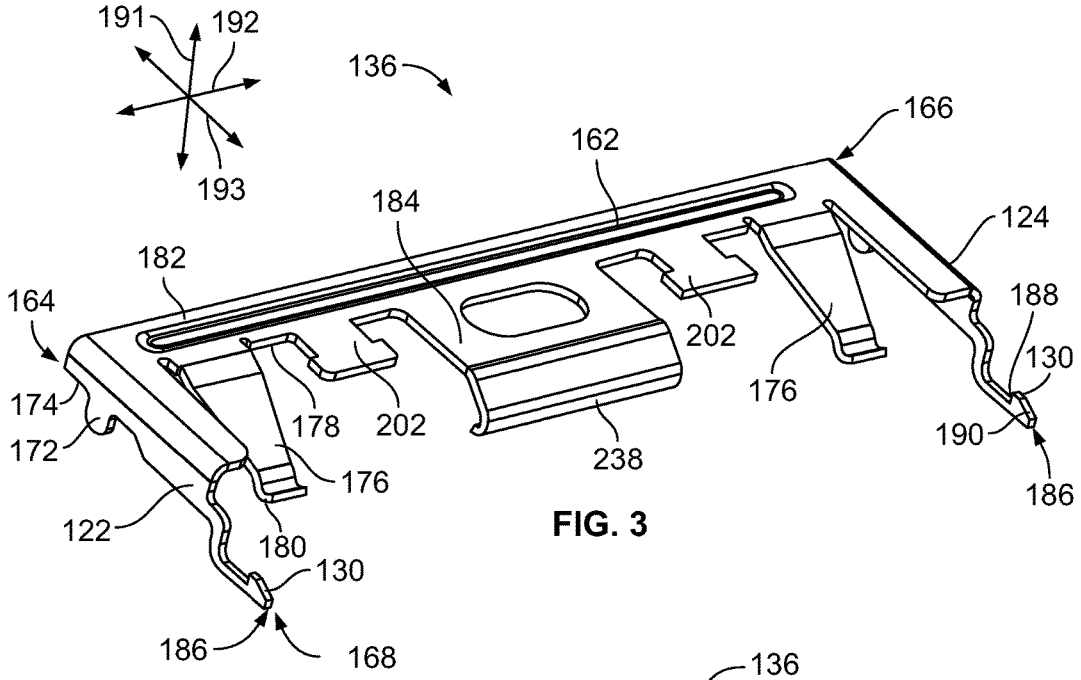
FIG. 3 is a perspective isolated view of a coupling device of the first electrical connector shown in FIG. 2.

Additional reference is now made to FIG. 3, which is a perspective isolated view of the coupling device 136 shown in FIG. 2. The coupling device 136 includes at least one axle 172 along which the coupling device 136 pivots between the locking position and the depressed position. The at least one axle 172 is disposed along or extends from a bottom side 174 of the coupling device 136. In the illustrated embodiment, each of the latch arms 122, 124 includes an axle 172 (although only one axle 172 is visible in FIG. 3). The axles 172 are located at least proximate to the ends 164, 166 of the stem 162. In an alternative embodiment, instead of two discrete axles 172, the coupling device 136 may include a single elongated axle that extends along the bottom side 174 of the coupling device 136 along the length of the stem 162. In another alternative embodiment, the housing 116 (shown in FIG. 2) includes an axle protruding from the platform surface 152 (FIG. 2), and the axle of the housing 116 defines a fulcrum on which the coupling device 136 pivots.

The coupling device 136 also includes one or more return spring beams 176 that are cantilevered and extend from the stem 162. The return spring beams 176 are configured to bias the coupling device 136 to the locking position. The return spring beams 176 may be located between the two latch arms 122, 124 along the length of the stem 162. In the illustrated embodiment, the coupling device 136 includes two return spring beams 176, but other embodiments may include only one or more than two return spring beams 176. The return spring beams 176 shown in FIG. 3 extend from a front side 178 of the stem 162. Distal tips 180 of the return spring beams 176 are curved to provide a non-stubbing contact surface that is configured to engage the platform surface 152 (shown in FIG. 2) of the housing 116 (FIG. 2). The return spring beams 176 are shaped to extend both frontward and downward from the stem 162 to engage the platform surface 152 disposed under the coupling device 136.

In an embodiment, the coupling device 136 has a unitary, one-piece body 182, such that the stem 162, the latch arms 122, 124, the axles 172, and one or more return spring beams 176 are formed integral with one another. The coupling device 136 may be composed of one or more metals, such as aluminum, copper, or the like. The coupling device 136 may be formed via a molding process, stamped and formed from a sheet or panel of metal, or cast. In an alternative embodiment, the coupling device 136 is not a unitary, one-piece body such that two or more of the components are attached together after forming the components.

The coupling device 136 may also include a release tab 184 that extends from the front side of the stem 162. The release tab 184 is configured to be actuated to selectively pivot the coupling device 136 from the locking position to the depressed position. For example, the release tab 184 aligns with and is engaged by the tether 140 (shown in FIG. 2). Depression of the push button 146 (FIG. 2) and/or pulling of the free segment 148 (FIG. 2) of the tether 140 pushes the release tab 184 downward. A distal end 238 of the release tab 184, which is spaced apart from the stem 162 by a length of the release tab 184, defines an inboard section of the front end 168 of the coupling device 136 that is between the two latch arms 122, 124. Since the release tab 184 extends frontward of the axles 172, downward movement of the release tab 184 pivots the front end 168 of the coupling device 136 downward. The release tab 184 is disposed between the two return spring beams 176 along the length of the stem 162. Each of the return spring beams 176 is located between the release tab 184 and a corresponding one of the latch arms 122, 124 along the length of the stem 162. In an alternative embodiment, instead of having a discrete release tab 184, the stem 162 may have a greater depth along the longitudinal axis 193 such that the stem 162 resembles the size of the release tab 184 shown in FIG. 3. In such an embodiment, the coupling device 136 is actuated by the tether 140 depressing the front side 178 of the stem The hook tips 130 of the latch arms 122, 124 are located at distal ends 186 of the latch arms 122, 124. The distal ends 186 of the latch arms 122, 124 represent outboard sections of the front end 168 of the coupling device 136. Each hook tip 130 includes a rear-facing catch surface 188 and a ramp surface 190 extending from the catch surface 188 to the distal end 186. The ramp surface 190 tapers from the catch surface 188 to the distal end 186.

Figure 4:
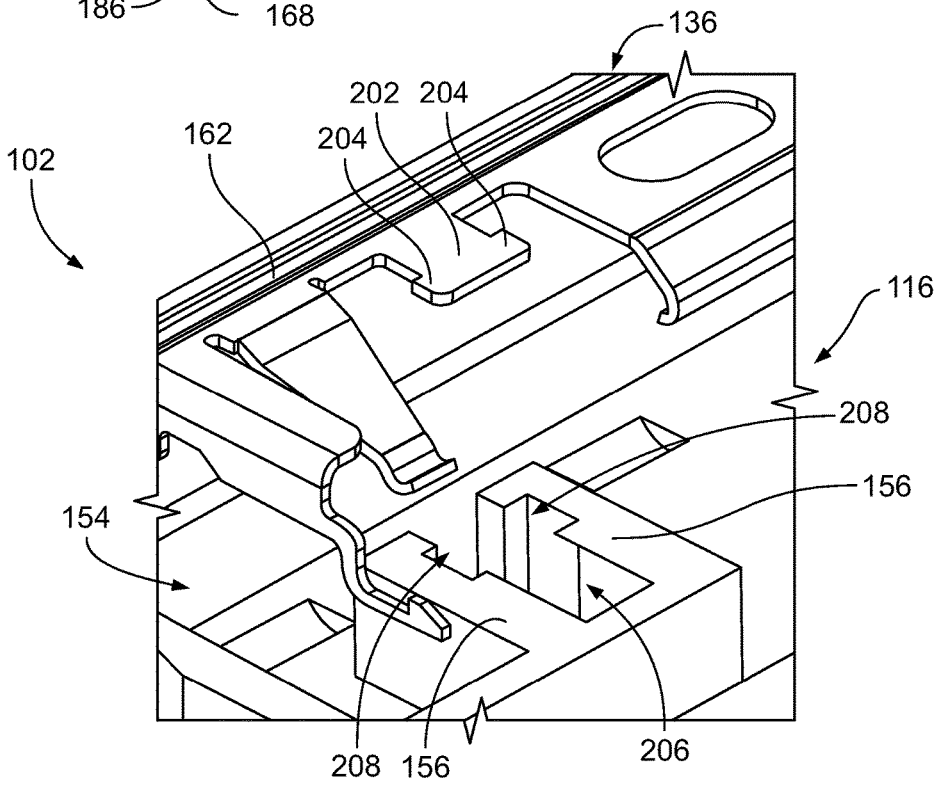
FIG. 4 is an exploded close-up view of a portion of the first electrical connector showing the coupling device poised for mounting within a compartment of a housing of the first electrical connector according to an embodiment.

FIG. 4 is an exploded close-up view of a portion of the plug connector 102 showing the coupling device 136 poised for mounting within the compartment 154 of the housing 116 according to an embodiment. As shown in FIG. 4, the walls 156 of the housing 116 define allotted spaces for the various components of the coupling device 136 within the compartment 154. For example, the coupling device 136 may include at least one retention tab 202 extending from the stem 162. The retention tab 202 is t-shaped with two opposing ears 204. When the coupling device 136 is mounted to the housing 116, the retention tab 202 is received within a retention cavity 206 defined by the walls 156. The retention cavity 206 includes notches 208 that receive the ears 204 of the retention tab 202. The retention tab 202 is allowed to move within the cavity 206 but is not allowed to exit the cavity 206 because the cover plate 142 (shown in FIG. 1) blocks the retention tab 202 from lifting fully out of the cavity 206. The engagement between the retention tab 202 and the walls 156 of the retention cavity 206 retains the coupling device 136 in a proper orientation within the compartment 154. As shown in FIG. 3, the coupling device 136 may include two retention tabs 202.

Figure 5:
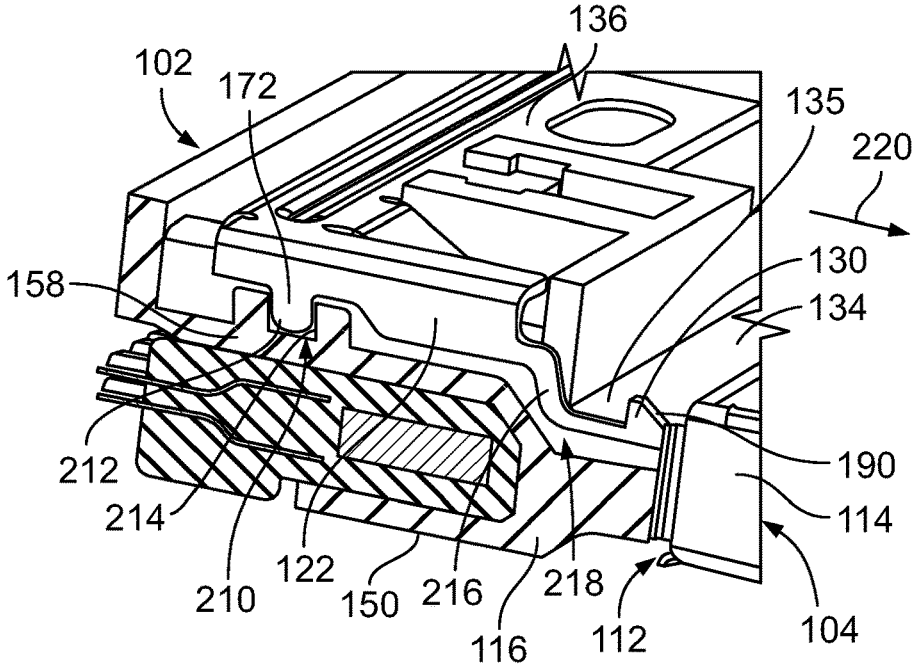
FIG. 5 is a cross-sectional side view of the first electrical connector according to an embodiment showing the coupling device in a locking position according to an embodiment.

FIG. 5 is a cross-sectional side view of the plug connector 102 according to an embodiment showing the coupling device 136 in the locking position according to an embodiment. The housing 116 is shown in cross-section to illustrate the orientation of the latch arm 122 and the axle 172 relative to the housing 116. The axle 172 is received within a slot 210 of the housing 116 that is sized to receive the axle 172 with only a slight clearance. The outer surface of the axle 172 is a journal surface 212 that engages and rotates relative to a bearing surface 214 of the slot 210 as the coupling device 136 pivots.

The latch arm 122 extends forward of the base portion 158 such that the hook tip 130 is located along the tongue portion 134 of the housing 116. The latch arm 122 includes a transition section 216 that steps downward. The housing 116 in the illustrated embodiment further includes a recess 218 that receives the latch arm 122 therein. The portion of the recess 218 along the tongue portion 134 extends downward from the outer surface 135 towards the bottom side 150 of the housing 116. In the locking position, the hook tip 130 of the latch arm 122 protrudes upward from the recess 218 beyond the outer surface 135. During a mating operation, as the plug connector 102 is received within the receptacle 112 of the receptacle connector 104 in a mating direction 220, the shell 114 engages the ramp surface 190 of the hook tip 130. The angle of the ramp surface 190 transfers the force direction and causes the latch arm 122 to pivot downward into the recess 218 out of the path of the shell 114. For example, the shell 114 of the connector 104 causes the coupling device 136 to pivot to the depressed position as the plug connector 102 is mated to the receptacle connector 104.

Figure 6:
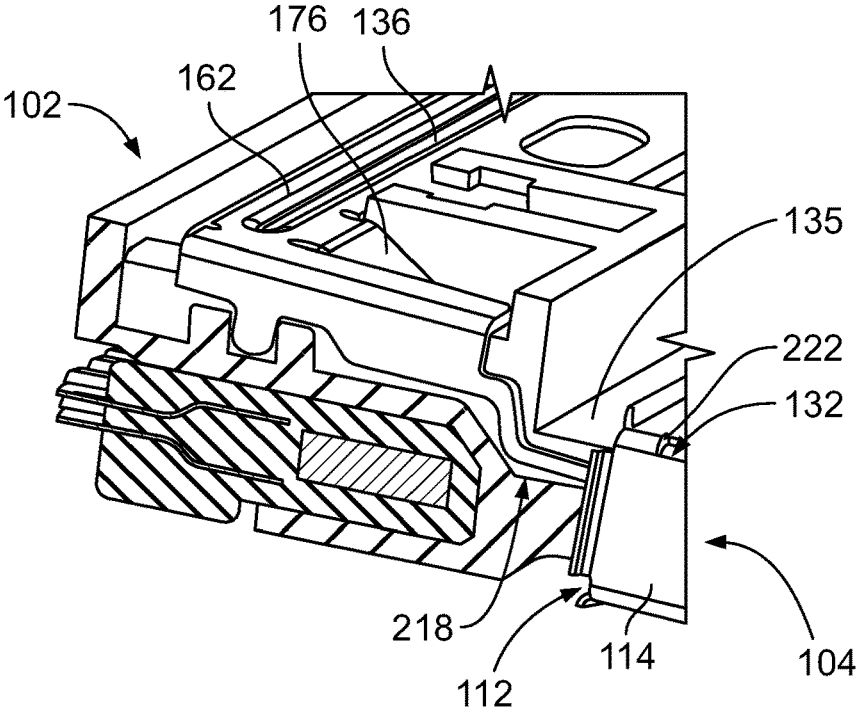
FIG. 6 is a cross-sectional side view of the first electrical connector according to an embodiment showing the coupling device in a depressed position.

FIG. 6 shows the coupling device 136 in the depressed position. The hook tip 130 (shown in FIG. 5) is within the recess 218 and either does not protrude beyond the outer surface 135 or protrudes only a slight amount such that the hook tip 130 does not extend into the path of the shell 114 of the receptacle connector 104. In the depressed position shown in FIG. 6, the hook tip 130 may be in engagement within an interior surface of the receptacle 112. The return spring beam 176 engages the platform surface 152 (shown in FIG. 2) and opposes the pivoting of the coupling device 136 to the depressed position. For example, as the coupling device 136 pivots downward, the return spring beam 176 is deflected between the stem 162 and the platform surface 152 from a natural resting position to a deflected position. Once the catch surface 188 (shown in FIG. 3) of the hook tip 130 passes an edge 222 of the opening 132, the coupling device 136 resiles to the locking position due to the resilience of the return spring beam 176. The return spring beam 176 biases the coupling device 136 to the locking position. The hook tip 130 extends beyond the outer surface 135 and is received through the opening 132 of the shell 114. The catch surface 188 is configured to engage the edge 222 to lock the connectors 102, 104 in the mated position.

Although the housing 116 is shown in cross-section in FIGS. 5 and 6, in one embodiment the housing 116 defines a recess 218 at each of first and second lateral edges of the tongue portion 134. Therefore, the latch arms 122, 124 received in the recesses 218 are located at the lateral edges of the tongue portion 134, which provides a wide latching stance for stability.

Figure 7:
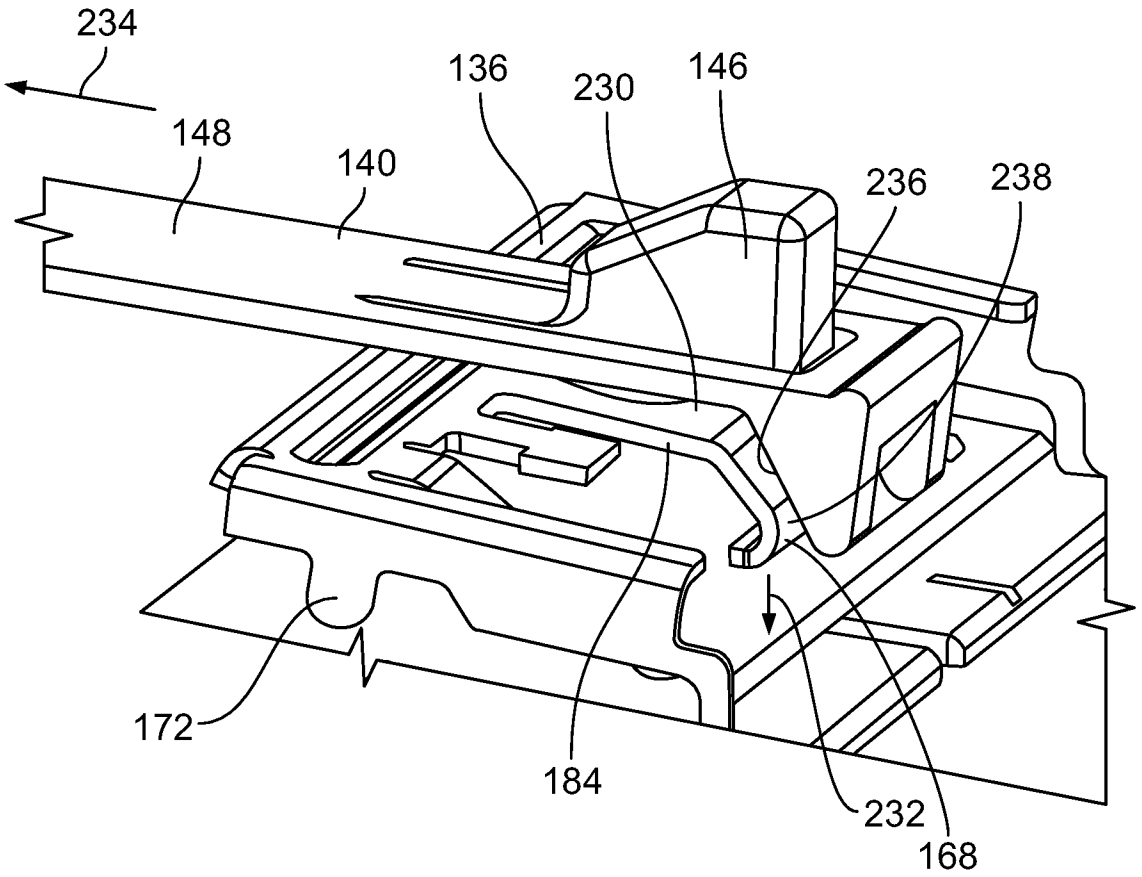
FIG. 7 is a perspective view of a portion of the coupling device and a tether according to an embodiment.

FIG. 7 is a perspective view of a portion of the coupling device 136 and the tether 140 according to an embodiment. FIG. 7 shows how the coupling device 136 can be selectively actuated to pivot from the locking position to the depressed position shown in FIG. 6 using the tether 140. For example, the user can depress the push button 146, which engages a top side 230 of the release tab 184 and forces the release tab 184 in a downward direction 232. Since the push button 146 engages the release tab 184 in front of the axle 172, the coupling device 136 pivots downward, causing the hook tips 130 (shown in FIGS. 1 and 5) to retract into the recesses 218 (FIG. 5). Additionally, pulling the free segment 148 of the tether 140 in a rearward direction 234 also actuates the coupling device 136. For example, the tether 140 includes a ramp surface 236 that engages the front end 168 of the coupling device 136 at the release tab 184. More specifically, the ramp surface 236 engages the distal end 238 of the release tab 184. Optionally, the distal end 238 of the release tab 184 is curved or slanted. As the tether 140 is pulled rearward, the ramp surface 236 of the tether 140 slides along the distal end 238 of the release tab 184. Since the cover plate 142 (shown in FIG. 1) restricts vertical movement of the tether 140, the distal end 238 of the release tab 184 is forced downward, causing the coupling device 136 to pivot from the locking position to the depressed position. The user may use the tether 140 to selectively actuate the coupling device 136 in order to, for example, release or uncouple the plug connector 102 from the receptacle connector 104 (both shown in FIG. 1).

Figure 8:
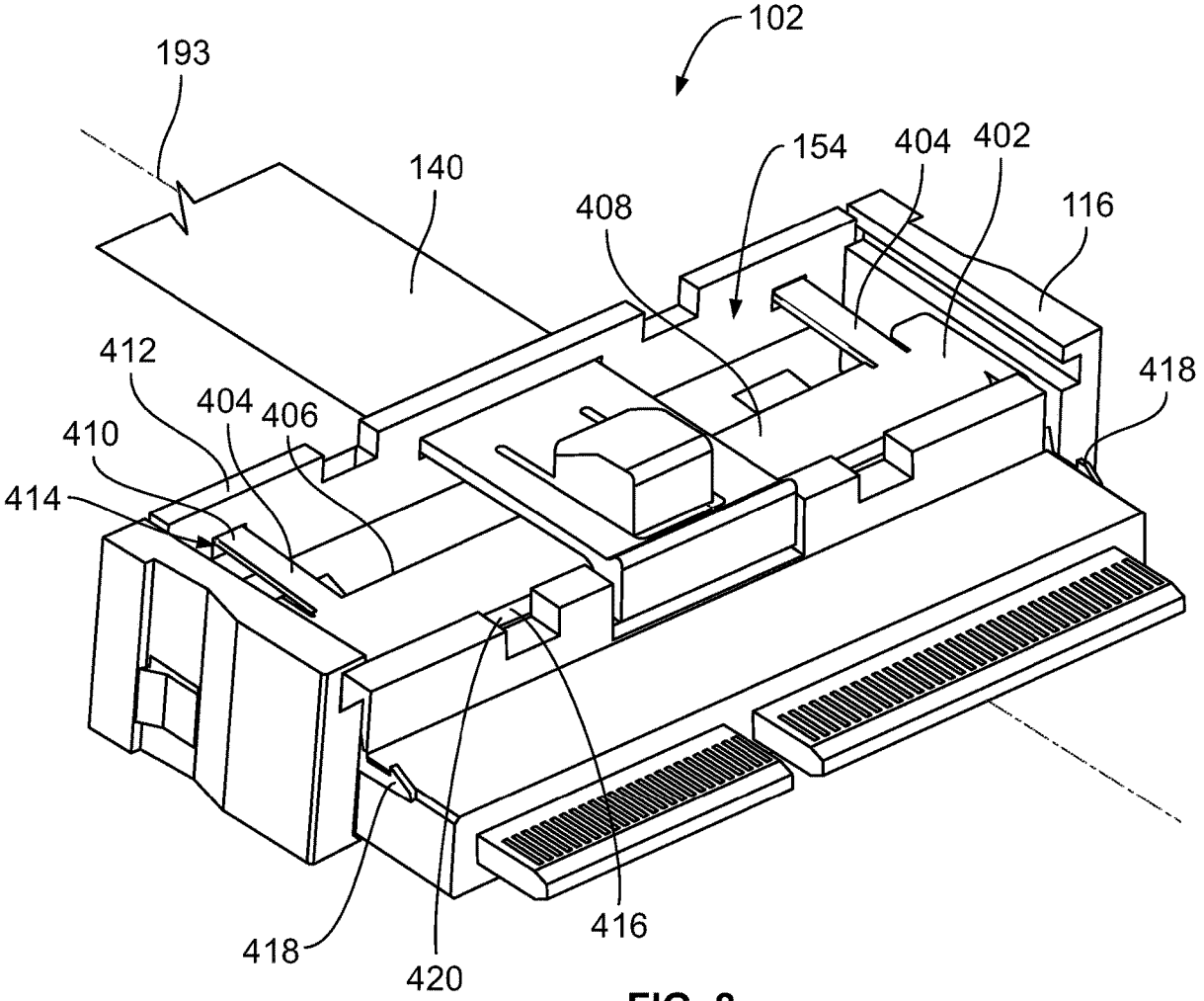
FIG. 8 is a perspective view of the first electrical connector according to an alternative embodiment.

FIG. 8 is a perspective view of the plug connector 102 according to an alternative embodiment. The cover plate 142 (shown in FIG. 1) is removed in order to show the components within the compartment 154 of the housing 116. The plug connector 102 in the illustrated embodiment includes a coupling device 402 that is similar to the coupling device 136 shown in FIGS. 2-7. For example, although not shown, the coupling device 402 includes axles similar to the axles 172 (shown in FIG. 3). Furthermore, the positions of hook tips 418 of the coupling device 402 relative to the housing 116 in the locking and depressed positions are the same. However, the coupling device 402 differs from the coupling device 136 in several aspects. The coupling device 402 includes two return spring beams 404 that extend from a rear side 406 of a stem 408. Distal tips 410 of the return spring beams 404 engage a back wall 412 of the housing 116. For example, the distal tips 410 optionally may be received within apertures 414 of the back wall 412. The distal tips 410 engage the back wall 412 to bias the coupling device 402 to the locking position. Furthermore, the coupling device 402 lacks a discrete release tab. Instead, the tether 140 engages the stem 408 directly to selectively actuate the coupling device 402. The stem 408 has a broader width along the longitudinal axis 193 than the stem 162 of the coupling device 136. A front side 416 of the stem 408 defines an inboard section of a front end 420 of the coupling device 402. Therefore, a downward force exerted on or near the front side 416 of the stem 408 causes the coupling device 402 to pivot about the axles from the locking position shown in FIG. 8 to the depressed position. The front side 416 of the stem 408 may be curved or angled to complement the ramp surface 236 (shown in FIG. 7) of the tether 140.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. An electrical connector comprising:

a housing holding a plurality of electrical conductors having contact portions disposed proximate to a mating end of the housing, and a coupling device mounted to the housing for selectively coupling the electrical connector to a mating connector, the coupling device including a stem elongated a length between a first end and second end and oriented to extend across the electrical conductors, the coupling device including first and second latch arms located at least proximate to the first and second ends of the stem, the first and second latch arms extending from the stem towards the mating end and having hook tips at distal ends thereof, the coupling device further including a return spring beam extending from the stem and located between the first and second latch arms along the length of the stem, wherein the coupling device is configured to pivot between a locking position and a depressed position, the hook tips of the first and second latch arms protruding beyond a mating interface surface of the housing a greater extent when in the locking position than when in the depressed position to latch onto the mating connector, the return spring beam engaging the housing to bias the coupling device to the locking position.

2. The electrical connector of claim 1, wherein the first and second latch arms extend from the stem towards the mating end of the housing, each of the hook tips of the first and second latch arms including a rear-facing catch surface and a ramp surface extending from the catch surface to the distal end of the respective latch arm.

3. The electrical connector of claim 1, wherein the coupling device includes at least one axle extending from a bottom side of the coupling device, the at least one axle having a journal surface engaging a bearing surface of the housing and rotating relative to the bearing surface as the coupling device pivots between the locking position and the depressed position.

4. The electrical connector of claim 1, wherein the housing includes a base portion and a tongue portion extending from the base portion to the mating end of the housing, the coupling device held in a compartment defined within the base portion, the tongue portion configured to be received within a receptacle of the mating connector, the mating interface surface of the housing being an outer surface of the tongue portion such that the hook tips of the latch arms protrude from the outer surface to latch onto the mating connector in the locking position.

5. The electrical connector of claim 1, wherein the coupling device is a unitary one-piece body.

6. The electrical connector of claim 1, wherein the coupling device is held in a compartment of the housing defined above a platform surface of the housing, the stem including a front side, the return spring beam extending forward from the front side of the stem, a distal tip of the return spring beam engaging the platform surface of the housing to bias the coupling device to the locking position.

7. The electrical connector of claim 1, wherein the coupling device is held in a compartment of the housing defined frontward of a back wall of the housing, the stem including a front side that faces the mating end of the housing and an opposite rear side that faces the back wall, the return spring beam extending rearward from the rear side of the stem such that a distal tip of the return spring beam engages the back wall of the housing to bias the coupling device to the locking position.

8. The electrical connector of claim 1, wherein the coupling device further includes a release tab extending from a front side of the stem, the release tab located between the first and second latch arms along the length of the stem, the release tab configured to be actuated to selectively pivot the coupling device from the locking position to the depressed position.

9. The electrical connector of claim 1, wherein the return spring beam is a first return spring beam and the coupling device further includes both a second return spring beam and a release tab extending from the stem, the first and second return spring beams both located between the first and second latch arms along the length of the stem, the release tab located between the first and second return spring beams along the length of the stem.

10. The electrical connector of claim 1, wherein the coupling device includes a front end that faces the mating end of the housing, the electrical connector further including a tether having a ramp surface that engages the front end of the coupling device at a location between the first and second latch arms, wherein rearward pulling of the tether causes the ramp surface to slide along the front end which pivots the coupling device from the locking position to the depressed position.

11. The electrical connector of claim 10, further comprising a cover plate mounted to the housing, the coupling device and the tether stacked vertically between the housing and the cover plate, a free segment of the tether protruding rearward from the housing.

12. An electrical connector comprising:

a housing holding a plurality of electrical conductors having contact portions disposed proximate to a mating end of the housing, the housing having a top side and a bottom side, the housing having a base portion defining a compartment extending vertically from a platform surface to the top side, the electrical conductors located between the platform surface and the bottom side, and a coupling device held in the compartment of the housing for selectively coupling the electrical connector to a mating connector, the coupling device including a stem elongated a length between a first end and second end and oriented to extend across the electrical conductors, the coupling device including first and second latch arms located at least proximate to the first and second ends of the stem, the first and second latch arms extending from the stem towards the mating end and having hook tips at distal ends thereof, wherein the coupling device is configured to pivot between a locking position and a depressed position, the hook tips of the first and second latch arms protruding beyond a mating interface surface of the housing a greater extent when in the locking position than when in the depressed position to latch onto the mating connector.

13. The electrical connector of claim 12, wherein the housing further includes a tongue portion extending from the base portion to the mating end of the housing, the tongue portion configured to be received within a receptacle of the mating connector, the mating interface surface of the housing being an outer surface of the tongue portion.

14. The electrical connector of claim 13, wherein the tongue portion of the housing extends laterally between first and second edges and defines a recess at each of the first and second edges, the hook tips of the latch arms protruding beyond the outer surface of the tongue portion when in the locking position and received within the recesses when in the depressed position.

15. The electrical connector of claim 12, wherein the coupling device includes a front end that faces the mating end of the housing, the electrical connector further including a tether having a ramp surface that engages the front end of the coupling device at a location between the first and second latch arms, wherein rearward pulling of the tether causes the ramp surface to slide along the front end which pivots the coupling device from the locking position to the depressed position.

16. The electrical connector of claim 15, wherein the tether includes a push button rearward of the ramp surface, the push button configured to be depressed into engagement with at least one of the stem or a release tab of the coupling device to selectively pivot the coupling device from the locking position to the depressed position.

17. The electrical connector of claim 12, wherein the coupling device further includes a return spring beam extending from the stem and located between the first and second latch arms along the length of the stem, the return spring beam engaging the housing to bias the coupling device to the locking position.

18. An electrical connector comprising:

a housing holding a plurality of electrical conductors having contact portions disposed proximate to a mating end of the housing, and a coupling device mounted to the housing for selectively coupling the electrical connector to a mating connector, the coupling device having a unitary, one-piece body that includes a stem, first and second latch arms, and first and second return spring beams, the stem elongated a length between a first end and second end and oriented to extend across the electrical conductors, the first and second latch arms located at least proximate to the first and second ends of the stem and extending from the stem towards the mating end, the first and second latch arms having hook tips at distal ends thereof, the first and second return spring beams extending from the stem and both located between the first and second latch arms along the length of the stem, wherein the coupling device is configured to pivot between a locking position and a depressed position, the hook tips of the first and second latch arms configured to latch onto the mating connector in the locking position and configured to release the mating connector in the depressed position, the first and second return spring beams engaging the housing to bias the coupling device to the locking position.

19. The electrical connector of claim 18, wherein the coupling device further includes a release tab extending from a front side of the stem towards the mating end of the housing, the release tab disposed axially between the first and second return spring beams along the length of the stem, the release tab configured to be actuated to selectively pivot the coupling device from the locking positing to the depressed position.

20. The electrical connector of claim 18, wherein the stem includes a front side that faces the mating end of the housing and an opposite rear side, the first and second return spring beams extending at least one of frontward from the front side or rearward from the rear side to engage the housing.

* * * * *